US010588398B2

(12) United States Patent
Jimenez et al.

(10) Patent No.: US 10,588,398 B2
(45) Date of Patent: Mar. 17, 2020

(54) ORAL CARE IMPLEMENT WITH ADJUSTABLE CLEANING ELEMENTS

(71) Applicant: Colgate-Palmolive Company, New York, NY (US)

(72) Inventors: Eduardo Jimenez, Manalapan, NJ (US); Douglas Hohlbein, Hopewell, NJ (US); Kenneth Waguespack, North Brunswick, NJ (US); Anthony Baxter, Upper Montclair, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/065,416

(22) PCT Filed: Dec. 28, 2015

(86) PCT No.: PCT/US2015/067679

§ 371 (c)(1),
(2) Date: Jun. 22, 2018

(87) PCT Pub. No.: WO2017/116396

PCT Pub. Date: Jul. 6, 2017

(65) Prior Publication Data

US 2019/0014897 A1 Jan. 17, 2019

(51) Int. Cl.
*A46B 9/04* (2006.01)
*A46B 5/00* (2006.01)
(Continued)

(52) U.S. Cl.
CPC ..... *A46B 9/04* (2013.01); *A46B 5/0037* (2013.01); *A46B 5/0075* (2013.01); *A46B 7/02* (2013.01);
(Continued)

(58) Field of Classification Search
CPC ... A46B 5/0037; A46B 5/0041; A46B 5/0045; A46B 5/0033; A46B 5/0025; A46B 7/02; A46B 9/04; A46B 7/06
(Continued)

(56) References Cited

U.S. PATENT DOCUMENTS 1,110,406 A * 9/1914 Schreck ..... A46B 7/06 15/201
1,927,365 A 9/1933 Frolio
(Continued)

FOREIGN PATENT DOCUMENTS

CN 1450881 A 10/2003
CN 105054572 11/2015
(Continued)

OTHER PUBLICATIONS

International Search Report and Written Opinion of the International Searching Authority in International Application No. PCT/US2015/067679, dated Jun. 3, 2016.

*Primary Examiner* — Laura C Guidotti

(57) ABSTRACT

In some embodiments an oral care implement herein may be embodied as a toothbrush having a head disposed at a distal end of a handle. The head may include a fixed bristle support and at least two movable bristle supports, movable relative to the fixed bristle support and relative to each other. An actuator is disposed to actuate the movable bristle supports between a brushing position in which bristles on the fixed bristle support and the movable bristle supports are substantially parallel and an interdental cleaning position in which the movable bristle supports are moved relative to each other such that the bristles on the movable bristle supports are angled toward each other. In the interdental cleaning position, the bristles may form a point or similar bristle tip, which may be useful for interdental cleaning.

20 Claims, 4 Drawing Sheets

(51) Int. Cl.
*A46B 7/02* (2006.01)
*A46B 7/06* (2006.01)

(52) U.S. Cl.
CPC ..... *A46B 7/06* (2013.01); *A46B 2200/108* (2013.01); *A46B 2200/1066* (2013.01)

(58) Field of Classification Search
USPC ..... 15/172, 201
See application file for complete search history.

(56) References Cited

U.S. PATENT DOCUMENTS

| | | | | |
|---|---|---|---|---|
| 2,254,365 | A | 9/1941 | Griffith | |
| 2,438,268 | A | 3/1948 | Bressler | |
| 4,783,874 | A | 11/1988 | Perches et al. | |
| 5,350,248 | A | 9/1994 | Chen | |
| 5,465,450 | A | 11/1995 | Humphries | |
| 6,230,356 | B1 | 5/2001 | Hyo-Moon | |
| 6,357,073 | B1 | 3/2002 | Yue | |
| 6,357,074 | B1 | 3/2002 | Weihrauch | |
| 6,442,786 | B2 | 9/2002 | Halm et al. | |
| 7,757,333 | B2 * | 7/2010 | Battaglia | A46B 5/0025 15/167.1 |
| 7,962,992 | B2 | 6/2011 | Cann | |
| 7,975,344 | B2 | 7/2011 | Braun et al. | |
| 8,239,995 | B2 | 8/2012 | Chenvainu et al. | |
| 2006/0075588 | A1 | 4/2006 | Amador | |
| 2012/0054971 | A1 | 3/2012 | Dugan | |

FOREIGN PATENT DOCUMENTS

| | | | | |
|---|---|---|---|---|
| DE | 19828582 | | 12/1999 | |
| DE | 102013112800 | | 3/2015 | |
| FR | 459442 | A | 11/1913 | |
| JP | 2009-240746 | A * | 10/2009 | A46B 9/04 |
| WO | 2003/001942 | | 1/2003 | |

* cited by examiner

ORAL CARE IMPLEMENT WITH ADJUSTABLE CLEANING ELEMENTS

BACKGROUND

Various products and processes have been developed to improve and maintain oral health. For example, toothbrushes have been developed with varied bristle configurations and compositions. Toothbrushes also conventionally have been provided with additional cleaning implements such as tongue scrapers and "picks," to offer varied oral cleaning capabilities. However, there remains a need in the art for improved implements capable of performing various cleaning tasks in the oral cavity.

Accordingly, there is a need in the art for effective oral care devices. This disclosure is directed at overcoming one or more problems set forth above and/or other problems of the prior art.

BRIEF SUMMARY

This application describes improved oral care implements. In some embodiments, an oral care implement herein may be embodied as a toothbrush having a head disposed at a distal end of a handle. The head may include a fixed bristle support and at least two movable bristle supports, movable relative to the fixed bristle support and relative to each other. An actuator is disposed to actuate the movable bristle supports between a brushing position in which bristles on the fixed bristle support and the movable bristle supports are substantially parallel and an interdental cleaning position in which the movable bristle supports are moved relative to each other such that the bristles on the movable bristle supports are angled toward each other. In the interdental cleaning position, the bristles may form a point or similar cluster, which may be useful to promote enhanced interdental cleaning.

In aspects of this disclosure, an oral care implement may include a handle extending from a proximal end to a distal end; a head disposed at the distal end of the handle, the head comprising: a fixed bristle member comprising a first plurality of bristles on a fixed bristle support, a first movable bristle member comprising a second plurality of bristles on a first movable bristle support, and a second movable bristle member comprising a third plurality of bristles on a second movable bristle support; and an actuator configured to move the first movable bristle member and the second movable bristle member to selectively place the head in a brushing position in which the second plurality of bristles and the third plurality of bristles are disposed in a first orientation relative to the first plurality of bristles or in an interdental cleaning position in which the second plurality of bristles and the third plurality of bristles are angled relatively toward each other to form a bristle tip and the bristle tip is angled relative to the first plurality of bristles.

In others aspects, in an oral care implement according to the preceding paragraph, the actuator comprises an elongate member contacting the first movable bristle member and the second movable bristle member and movable relative to the fixed bristle member.

In other aspects, in an oral care implement according to the preceding paragraph, the elongate member contacts the first movable bristle member and the second movable bristle member proximate a first end and is fixed at an opposite, second end, to an actuatable member.

In others aspects, in an oral care implement according to the preceding paragraph, the actuatable member is configured for actuation by a user to move the actuator between the brushing position and the interdental cleaning position.

In others aspects, in an oral care implement according to any of the preceding three paragraphs, the elongate member is fixed to at least one of the first movable bristle member or the second movable bristle member.

In others aspects, in an oral care implement according to any of the preceding paragraphs a first hinge connects the first movable bristle member to the fixed bristle member and a second hinge connects the second movable bristle member to the fixed bristle member.

In others aspects, in an oral care implement according to the preceding paragraph, the first hinge and the second hinge are living hinges.

In others aspects, in an oral care implement according to either of the preceding two paragraphs, the first hinge is configured to allow rotation of the first movable bristle member about a first axis of rotation, the second hinge is configured to allow rotation of the second movable bristle member about a second axis of rotation, and the first axis and the second axis are angled relative to each other.

In others aspects, in an oral care implement according to any of the preceding paragraphs, in the interdental cleaning configuration, the bristle tip is angled relatively toward the first plurality of bristles or relatively away from the first plurality of bristles.

In another aspect of this disclosure, an oral care implement includes a handle; a head disposed at a distal end of the handle, the head comprising: a fixed cleaning member support, a first cleaning member disposed on the fixed cleaning member support, a first movable cleaning member support movable relative to the cleaning member support, a second cleaning member disposed on the first moveable cleaning member support, a second movable cleaning member support moveable relative to the cleaning member support and the first movable cleaning member support, and a third cleaning member disposed on the second moveable cleaning member support; and an actuator disposed to pivot the first movable cleaning member support relative to the fixed cleaning member support about a first axis, to pivot the second movable cleaning member support relative to the fixed cleaning member support about a second axis, and the second movable cleaning member support relative to the fixed cleaning member support, and to actuate at least one of the first movable cleaning member and the second movable cleaning member support relative to each other.

In others aspects, in an oral care implement according to the preceding paragraph the actuator comprises an elongate member disposed in the toothbrush.

In others aspects, in an oral care implement according to the preceding paragraph the elongate member extends from a proximal end disposed in the handle to a distal end contacting at least one of the first movable cleaning member support or the second movable cleaning member support.

In others aspects, in an oral care implement according to either of the two preceding paragraphs, the elongate member includes at the distal end a first member contacting the first movable bristle support and a second member contacting the second movable bristle support.

In others aspects, in an oral care implement according to the preceding paragraph the first member is fixed relative to the second member.

In others aspects, in an oral care implement according to any of the preceding five paragraphs, a first hinge connects the first movable cleaning element support to the fixed cleaning element support and a second hinge connects the second movable cleaning element support to the fixed bristle support.

In others aspects, in an oral care implement according to any of the preceding six paragraphs, the first cleaning element comprises a first plurality of bristles, the second cleaning element comprises a second plurality of bristles, and the third cleaning element comprises a third plurality of bristles.

In others aspects, in an oral care implement according to the preceding paragraph the actuator is adjustable between a first position that configures the head in a first configuration and a second position that configures the head in a second configuration, wherein in the first configuration the second plurality of bristles and the third plurality of bristles generally are parallel and wherein in the second configuration the second plurality of bristles and the third plurality of bristles are angled relative to each other.

In others aspects, in an oral care implement according to the preceding paragraph, in the second configuration distal ends of the bristles comprising the second plurality of bristles are angled toward distal ends of the bristles comprising the third plurality of bristles to form a bristle tip.

In others aspects, in an oral care implement according to the preceding paragraph the bristle tip is angled relative to the first plurality of bristles.

In yet another aspect of this disclosure, a toothbrush includes a handle extending from a proximal end to a distal end; and a head disposed at the distal end of the handle. The head includes a fixed bristle member comprising a first plurality of bristles on a fixed bristle support, a first movable bristle member comprising a second plurality of bristles on a first movable bristle support, a first hinge connecting the first movable bristle member to the fixed bristle member, wherein the first movable bristle member pivots relative to the fixed bristle support, via the first hinge, about a first axis, a second movable bristle member comprising a third plurality of bristles on a second movable bristle support, and a second hinge connecting the second movable bristle member to the fixed bristle member, wherein the second movable bristle member pivots relative to the fixed bristle support, via the second hinge, about a second axis angled relative to the first axis.

In others aspects, in a toothbrush according to the preceding paragraph, an actuator is disposed to pivot the first movable bristle member relative to the fixed bristle member, via the first hinge, about the first axis and disposed to pivot the second movable bristle member relative to the fixed bristle member, via the second hinge, about the second axis.

In others aspects, in an oral care implement according to either of the preceding two paragraphs, when the first movable bristle member is pivoted relative to the fixed bristle member and the second movable bristle member is pivoted relative to the fixed bristle member, distal ends of the bristles comprising the second plurality of bristles are angled toward distal ends of the bristles comprising the third plurality of bristles to form a bristle tip.

In others aspects, in an oral care implement according to any of the preceding three paragraphs, at least one of the first hinge and the second hinge are living hinges.

Further areas of applicability of the present disclosure will become apparent from the detailed description provided hereinafter. It should be understood that the detailed description and specific examples, which may relate to some presently-preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of some presently-preferred embodiments of this disclosure is merely exemplary in nature and is in no way intended to limit the disclosure, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

This disclosure relates generally to oral care implements, and more particularly to oral care implements that may be useful to perform different oral cleaning tasks. In some embodiments, for example, a toothbrush may include that can be positioned in both a first configuration that promotes conventional tooth brushing and a second configuration for interdental cleaning. Although certain embodiments and benefits will be described, other implementations, modifications, and/or benefits will be appreciated by those having ordinary skill in the art, with the benefit if this disclosure. For example, the following detailed description may generally refer to embodiments of the inventive implements in the context of a toothbrush, but the disclosure is not limited to toothbrushes; other oral care implements may also incorporate features of this disclosure. By way of non-limiting example, embodiments of this disclosure may not include bristles, instead using rubber or polymeric protrusions as cleaning elements in the place of bristles.

Figure 1A:
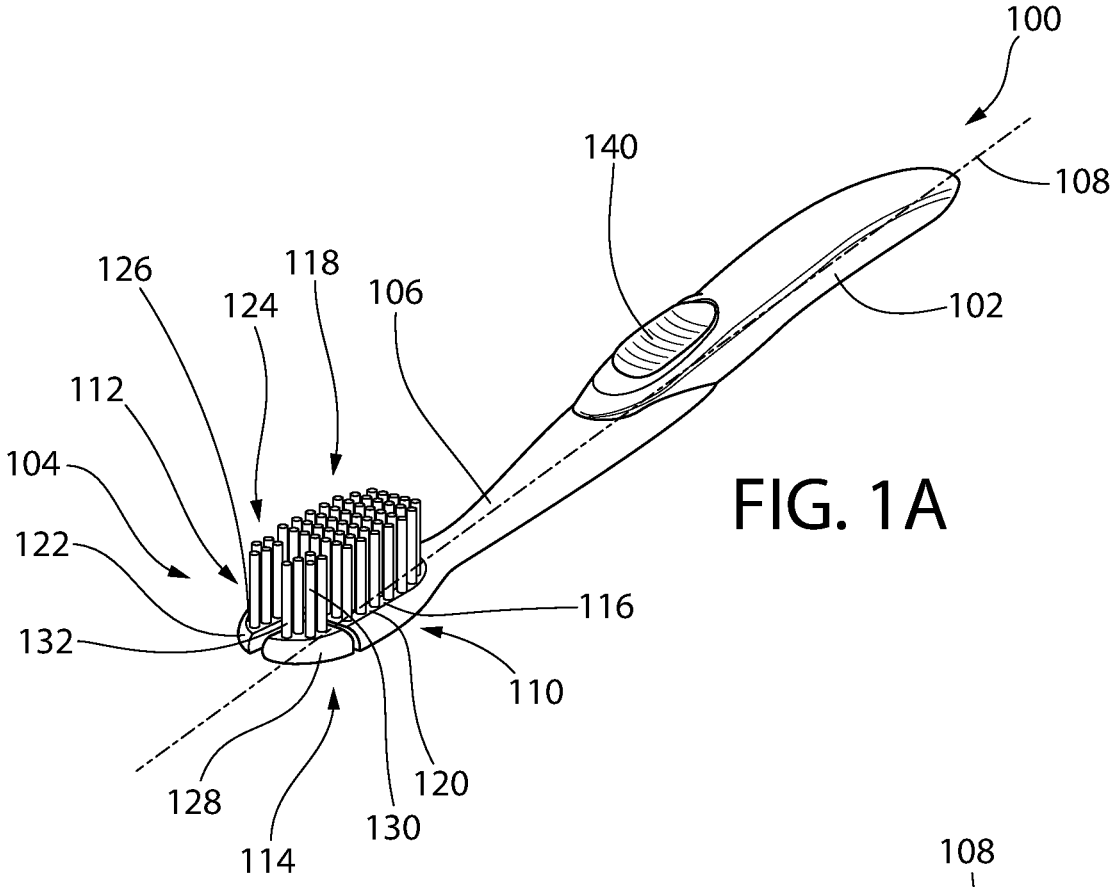
FIG. 1A is a perspective view of an oral care implement in a tooth brushing configuration, according to an example implementation of this disclosure.
Figure 1B:
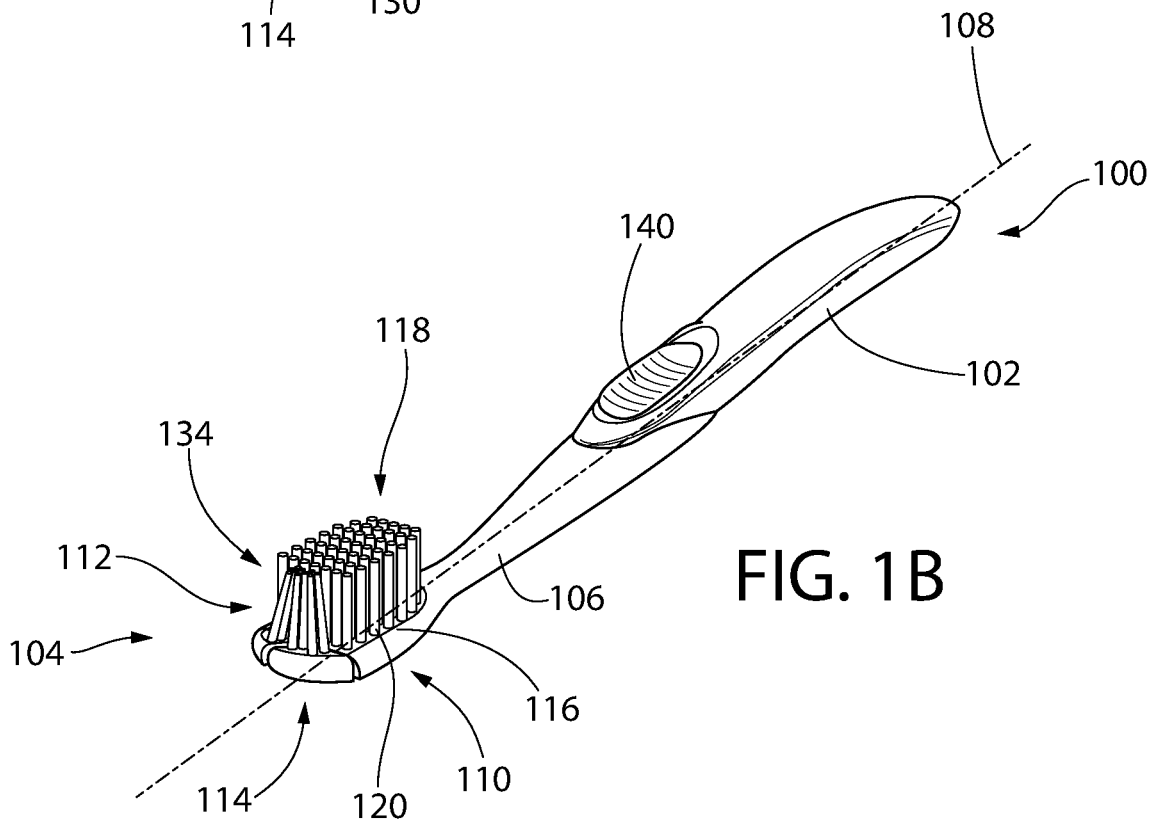
FIG. 1B is a perspective view of the oral care implement of FIG. 1A in an interdental cleaning configuration, according to an example implementation of this disclosure.

FIGS. 1A and 1B illustrate an oral care implement 100 according to embodiments of this disclosure. The oral care implement 100 is embodied as a toothbrush and generally includes a handle 102, a head 104 disposed at the distal end of the handle 102, and a neck portion 106 generally disposed between the handle 102 and the head 104. As illustrated, the toothbrush has a generally elongate shape, extending along a longitudinal axis 108. This disclosure is not limited to the shape and/or size of the toothbrush illustrated in FIGS. 1A and 1B. In alternative implementations, one or more of the handle 102, head 104, and/or neck 106 may have different shapes, sizes, orientations, and/or the like. Additional features may also be incorporated into the toothbrush or disposed on the toothbrush.

The head 104 of the oral care implement 100 includes a fixed cleaning element 110, a first movable cleaning element 112, and a second movable cleaning element 114. The fixed cleaning element 110 generally includes a fixed bristle support 116 and a plurality of bristles 118 extending from a surface 120 of the fixed bristle support 114. In the illustration, the bristles 118 are generally parallel to each other, and extend generally perpendicularly from the surface 120 of the fixed bristle support 114. The first movable cleaning element 112 generally includes a first movable bristle support 122 and a plurality of bristles 124 extending from a surface 126 of the first movable bristle support 122. In the illustration, the bristles 124 are generally parallel to each other, and extend generally perpendicularly from the surface 126. The second movable cleaning element 114 is similar to the first movable cleaning element 112, and generally includes a second movable bristle support 128 and a plurality of bristles 130 extending from a surface 132 of the second movable bristle support 128. The bristles 130 are illustrated as being generally parallel to each other, and extend generally perpendicularly from the surface 132.

The first movable cleaning element 112 and the second movable cleaning element 114 are movable relative to each other, as well as relative to the fixed cleaning element 110. For example, FIG. 1A illustrates a first, tooth brushing configuration of the cleaning elements 110, 112, 114. In this tooth brushing arrangement, the toothbrush may be used as a conventional toothbrush, for example, with all bristles generally parallel to each other or otherwise arranged for conventional brushing. FIG. 1B illustrates a second, interdental cleaning arrangement of the cleaning elements 110, 112, 114, which may be better suited for other oral cleaning applications, including interdental cleaning. As illustrated in FIG. 1B, in the interdental cleaning arrangement, the first movable cleaning element 112 and the second movable cleaning element 114 are moved relative to each other such that the bristles 124 of the first movable cleaning element 112 and the bristles 130 of the second movable cleaning element 114 are angled toward each other. In this configuration, distal ends of the bristles 124, 130, i.e., ends spaced from the respective surface 126, 132, become more closely spaced, even overlapping or crossing. Thus, a bristle tip 134 or point of bristles may result, which may be better suited for concentrated interdental cleaning.

As also illustrated in FIG. 1B, when in the interdental cleaning configuration, the first movable cleaning element 112 and the second movable cleaning element 114 are moved relative to the fixed cleaning element 110. In this implementation, the distal ends of the bristles 124, 130 are pivoted or tilted toward the bristles 118 of the fixed cleaning element 110. Thus, bristles comprising the bristles 118 may also form a portion of the bristle tip 134.

The bristles 118, 124, 130 may be formed as bristle tufts. The tufts may be formed with bristles of the same or different bristle materials (such as nylon bristles, spiral bristles, rubber bristles, etc.). Moreover, while the bristles 118, 124, 130 may be arranged so that they are generally perpendicular to the respective surfaces 120, 126, 132 from which they depend, some or all of the tooth cleaning elements may be angled at various angles with respect to the bottom surface. When bristle tufts are provided, it may be possible to select the combination of bristle configurations, bristle materials and/or bristle orientations to achieve specific intended results and operational characteristics, thus maximizing and enhancing cleaning, tooth polishing, tooth whitening, massaging, stimulation, and the like.

The bristles 118 may be attached to the respective bristle support 116, 122, 128 by any conventional method. In certain embodiments, the bristles may be secured to a plate having a plurality of holes formed therethrough, and the bristles may be mounted to the plate within the holes. This type of technique for mounting the bristles to a plate, such as a head plate, is generally known as anchor free tufting (AFT). In AFT a plate or membrane is created and the tooth cleaning elements (such as bristles, elastomeric elements, and combinations thereof) are positioned into the plate so as to extend through the holes of the plate. The free ends of the tooth cleaning elements on one side of the head plate perform the cleaning function. The ends of the tooth cleaning elements on the other side of the head plate are melted together by heat to be anchored in place. As the tooth cleaning elements are melted together, a melt matte is formed, which is a layer of plastic formed from the collective ends of the tooth cleaning elements that connects the tooth cleaning elements to one another on one side of the plate and prevents the tooth cleaning elements from being pulled through the tuft holes.

In some conventional designs, such as some conventional manual toothbrushes, after the tooth cleaning elements are secured to the plate, the plate may be secured to the head 104, such as by ultrasonic welding. When the head plate is coupled to the head 104, the melt matte is located between a lower surface of the head plate and a floor of a basin or cavity of the head 104 in which the head plate is disposed. The melt matte, which is coupled directly to and in fact forms a part of the tooth cleaning elements, prevents the tooth cleaning elements from being pulled through the holes in the plate, thus ensuring that the tooth cleaning elements remain attached to the plate during use of the oral care implement. In embodiments of this disclosure, the three groups of bristles 118, 124, 130 may be formed separately, and fixed relative to the respective fixed cleaning element 110, the first movable cleaning element 112, or the second movable cleaning element 114.

In another embodiment, the bristles may be connected to a plate or membrane using a technique known in the art as AMR. In this technique, a head plate is provided and the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some conventional applications, after formation of the melt matte, a tissue cleaner is injection molded onto the rear surface of the head plate, thereby trapping the melt matte between the tissue cleaner and the rear surface of the head plate. Other structures may be coupled to the rear surface of the head plate to trap the melt matte between the rear surface of the head plate and such structure without the structure necessarily being a tissue cleaner. For example, in embodiments of this disclosure, a structure covering the melt matte may be a plastic material that is used to form a smooth rear surface of the head, or the like. In still other embodiments, the structure can be molded onto the rear surface of the head plate or snap-fit (or other mechanical coupling) to the rear surface of the head plate as desired.

Of course, techniques other than AFT and AMR can be used for mounting bristles, such as widely known and used stapling/anchoring techniques or the like. In such embodiments the bristles 118, 124, 130 may be coupled directly to the head. Furthermore, in a modified version of the AFT process discussed above, the head plate may be formed by positioning the bristles and/or other tooth cleaning elements within a mold, and then molding the head plate around the tooth cleaning elements via an injection molding process. However, it should be appreciated that certain of the bristle tufts disclosed herein may not be adequately secured to the head using staple techniques, and one of AFT or AMR may therefore be preferred for securing such bristle tufts.

Moreover, in certain embodiments, the invention can be practiced with various combinations of stapled, IMT, AMR, or AFT cleaning elements. Alternatively, the tooth cleaning elements could be mounted to tuft blocks or sections by extending through suitable openings in the tuft blocks so that the base of the tooth cleaning elements is mounted within or below the tuft block. In still other embodiments, likely in which the tooth cleaning elements are not bristles, the tooth cleaning elements may be molded integrally with the head.

As noted above, both the first movable cleaning element and the second movable cleaning element are movable relative to the fixed cleaning element in the illustrated embodiment. In FIGS. 1A and 1B (and illustrated in FIG. 3), a hinge 136 connects the first movable cleaning element 112 to the fixed cleaning element 110 and a hinge 138 connects the second movable cleaning element 114 to the fixed cleaning element 110. As illustrated, the hinges 136, 138 are angled relative to each other, i.e., an axis of rotation for the hinge 136 and an axis of rotation for the hinge 138 are not co-linear and not parallel. Moreover, those axes are not perpendicular to the longitudinal axis 108, although one could be in some embodiments. Instead, the axes of the hinges 136, 138 form a "v" shape, with the "point" of the "v" being disposed generally along the longitudinal axis 108 and the "legs" of the "v" extending from the point in opposite directions of the longitudinal axis 108, to a position closer to the handle 102 than the point of the "v." With this arrangement, actuation of each of the first movable cleaning element 112 and the second movable cleaning element 114 causes the respective bristles 124, 130 to move toward each other, e.g., to form the bristle tip 134. In the illustrations, the hinges 136, 138 are living hinges 136, 138 although in other embodiments one or more different types of hinge may be provided to promote relative motion. For example, hinges of a different material (than the head) and/or separately fixed to the first and second movable cleaning element may be used in some embodiments.

The relative angle of the hinges 136, 138 also may be varied, e.g., to vary the construction of the bristle tip 134 when the head is in the interdental cleaning position. As will be appreciated, any relative angle between the hinges will result in the distal ends of the bristles moving relative (closer to or farther from) each other. Moreover, although the hinges 136, 138 are illustrated as angled symmetrically about the longitudinal axis 108, this arrangement is not required. Specifically, an angle between the hinge 136 and a line parallel to the longitudinal axis may be different than an angle between the hinge 138 and the line parallel to the longitudinal axis. In some implementations, the rotational axes of the hinges 136, 138 may be co-linear, although in such an arrangement the bristles on the movable elements 112, 114 would not move relatively closer to each other.

As also illustrated in FIGS. 1A and 1B, the toothbrush 100 includes a movable button or slider 140 provided as an actuating member. The slider 140 is manually movable between a first position and a second position to selectively configure the toothbrush in the tooth brushing configuration or the interdental cleaning configuration. The slider 140 acts with other components to form an actuator that facilitates the movement of the first and second movable cleaning elements 112, 114.

Figure 2A:
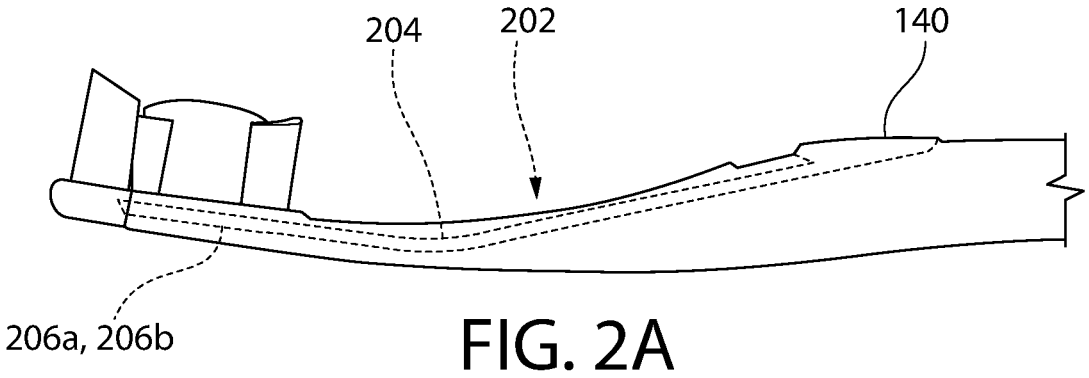
FIG. 2A is an elevation side view of the oral care implement of FIG. 1A in the tooth brushing configuration shown in FIG. 1A.
Figure 2B:
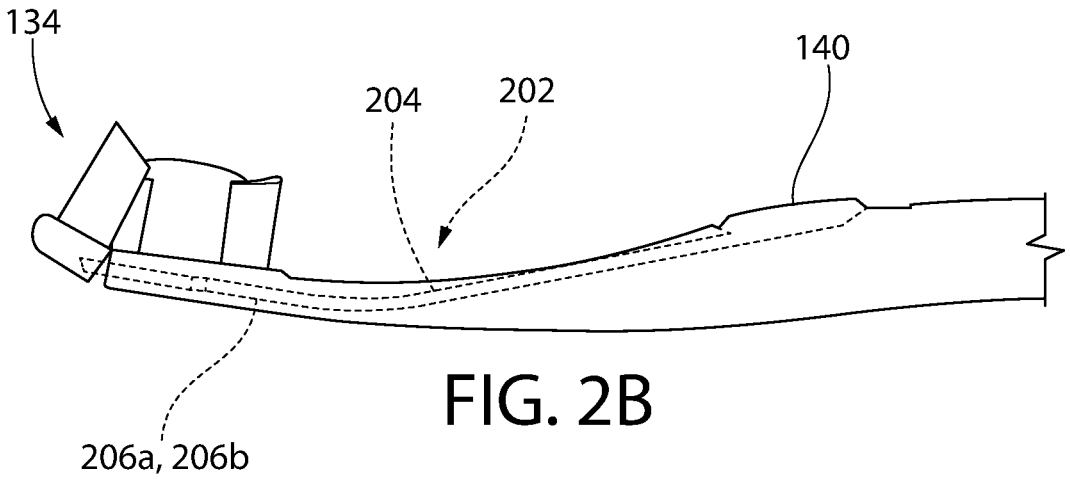
FIG. 2B is an elevation side view of the oral care implement illustrated in FIG. 1B, in the interdental cleaning configuration shown in FIG. 1B.
Figure 3:
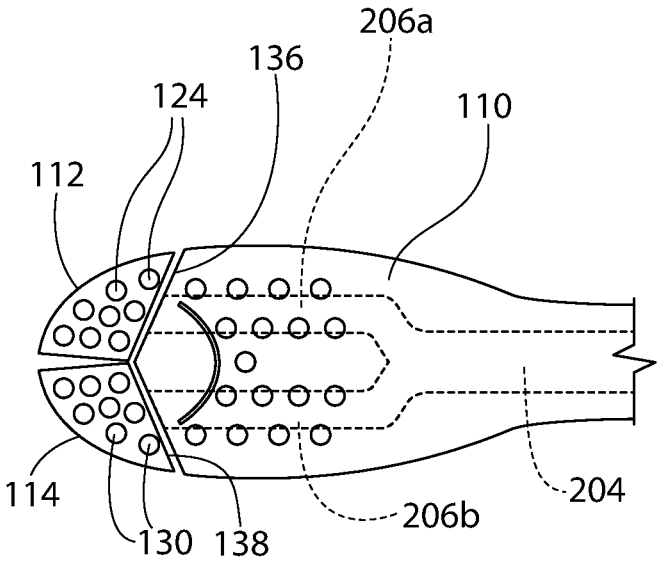
FIG. 3 is a plan view of the head of the oral care implement of FIGS. 1A, 1B, 2A and 2B, according to an example implementation of this disclosure.

Details of an example actuator 202 are illustrated in FIGS. 2A, 2B, and 3. Specifically, FIG. 2A is a partial side view of the toothbrush 100 in the brushing position shown in FIG. 1A, FIG. 2B is a similar partial side view of the toothbrush 100 in the interdental cleaning position shown in FIG. 1B, and FIG. 3 is a schematic top view of the head 106. In these Figures, the actuator 202 includes an elongate arm 204 extending from the button 140 to the first movable cleaning element 112 and the second movable cleaning element 114. In the illustration, the elongate arm 204 is disposed inside the toothbrush, e.g., in a cavity extending through the neck 106 and the head 104. In other embodiments, some of or the entire elongate arm may be disposed external to the neck and/or head. For example, the elongate arm may extend along or proximate a back surface of the toothbrush, e.g., opposite the bristles or along or proximate a side surface. As illustrated, the elongate arm 204 may be contoured, e.g., to match a contour of the toothbrush. In other embodiments, the elongate arm may be substantially linear. The elongate arm preferably is a rigid arm, and may be made of any suitable material. For example, the elongate arm may be made from a polymer or metal.

As illustrated, the elongate arm 204 is fixed or otherwise connected at one end to the button 140. At the other end, the arm communicates with the movable cleaning elements 112, 114. As best illustrated in FIG. 3, the end of the elongate arm 204 communicating with the movable cleaning elements 112, 114 may include two attachment portions 206*a*, 206*b*, one for cooperation with each of the movable cleaning elements 112, 114. In the illustrated embodiment, the elongate arm 204 is forked to provide the spaced attachment portions 206*a*, 206*b*. In other embodiments, a separate arm 204 could be provided for each of the movable cleaning elements 112, 114. Those arms may be affixed to the button 140 such that they both move in unison, or other embodiments could include two buttons, e.g., to allow for independent actuation of each of the movable cleaning elements 112, 114.

As best illustrated in FIGS. 2A and 2B, the elongate arm 204 contacts the movable cleaning elements 112, 114 at a position spaced from the hinge 136, 138. In operation, a user may move the button to move the elongate arm 204 generally along the axis 108. The elongate arm 204 acts as a linkage between the button 140 and the movable cleaning elements that causes the first movable cleaning element 112 to pivot about the hinge 136 and the second movable cleaning element 114 to pivot about the hinge 138. By way of specific example, when a user moves the button from the position shown in FIG. 1A to the position shown in FIG. 1B, the elongate arm causes the movable cleaning elements to pivot about the respective hinges, thereby forming the bristle tip 134. Similarly, when the button is moved from the position shown in FIG. 1B to the position shown in FIG. 1A, the movable cleaning elements will move to a position that places the head in the tooth brushing configuration. The angle of pivot about which each of the cleaning elements 112, 114 rotates is controlled by the displacement of the elongate arm 204 in the elongate direction.

In some embodiments, the attachment portions 206*a*, 206*b* may be physically fixed to the movable cleaning elements 112, 114, e.g., by press fitting, adhesive, overmolding, or the like. In other examples, however, it may be desirable to provide a relationship in which the spaced attachment portions 206*a*, 206*b* merely contacts the movable cleaning elements 112, 114, but the movable cleaning elements also move relative to the attachment portions. For example, in the illustrated example, the force applied by the elongate arm to each of the movable cleaning elements is generally along the longitudinal axis, whereas the axis of rotation about which each of the movable cleaning elements 112, 114 pivots is not perpendicular to the longitudinal axis. One would expect this configuration to put some strain on a fixed joint between the attachment portions 206*a*, 206*b* and the respective movable cleaning elements. Not fixing the arm to the movable elements could prevent some of this strain. Alternatively, or in addition, the attachment portions 206*a*, 206*b* could be angled relative to each other, for example, at an angle that situates the attachment portions 206*a*, 206*b* substantially perpendicular to the axis of the rotation of the respective movable cleaning elements 112, 114. This may reduce, although likely not entirely remove, strain on a joint at the attachment.

When the elongate arm 202 is not fixed to the movable cleaning elements 112, 114, it may necessary to insure that the head returns to the tooth brushing configuration when the button is moved into the position illustrated in FIG. 1A from the position shown in FIG. 1B. To this end, the hinges 136, 138 may include a natural bias that will return the head to the brushing position absent an applied force by the elongate arm. In other embodiments, the attachment portions 206*a*, 206*b* may not be fixed to the cleaning elements, but may include a feature that contacts a portion of the respective movable cleaning elements 112, 114 to physically move those cleaning elements into the brushing position. For example, ends of the attachment portions 206*a*, 206*b* may include a protrusion or the like that contacts a surface or other feature fixed on the movable cleaning element and facing away from the button in the axial direction. In this manner, by actuating the button 140 to the position illustrated in FIGS. 1A and 2A from the position illustrated in FIGS. 1B and 2B, the protrusion acts on the surface or other feature to "pull" the movable cleaning elements back to their tooth brushing position.

FIGS. 4A, 4B, 5A, and 5B illustrate an example of a toothbrush 400 according to another example embodiment of this disclosure. In those Figures, the toothbrush 400 generally includes a head 402 having a fixed cleaning element 404, a first movable cleaning element 406, and a second movable cleaning element 408. As in the toothbrush 100 described above, the fixed cleaning element generally includes a fixed bristle support 410 and bristles 412 extending from a surface 414 of the fixed bristle support 410. The first movable cleaning element 406 includes a first movable bristle support 416 and bristles 418 extending from a surface 420 of the first movable bristle support 416. Similarly, the second movable cleaning element 408 includes a second movable bristle support 422 and bristles 424 extending from a surface 426 of the second movable bristle support. Also like the toothbrush 100, the toothbrush 400 includes a hinge 428 allowing for movement of the first movable cleaning element 406 relative to the fixed cleaning element 404 and a hinge 430 allowing for movement of the second movable cleaning element 408 relative to the fixed cleaning element.

Figure 4A:
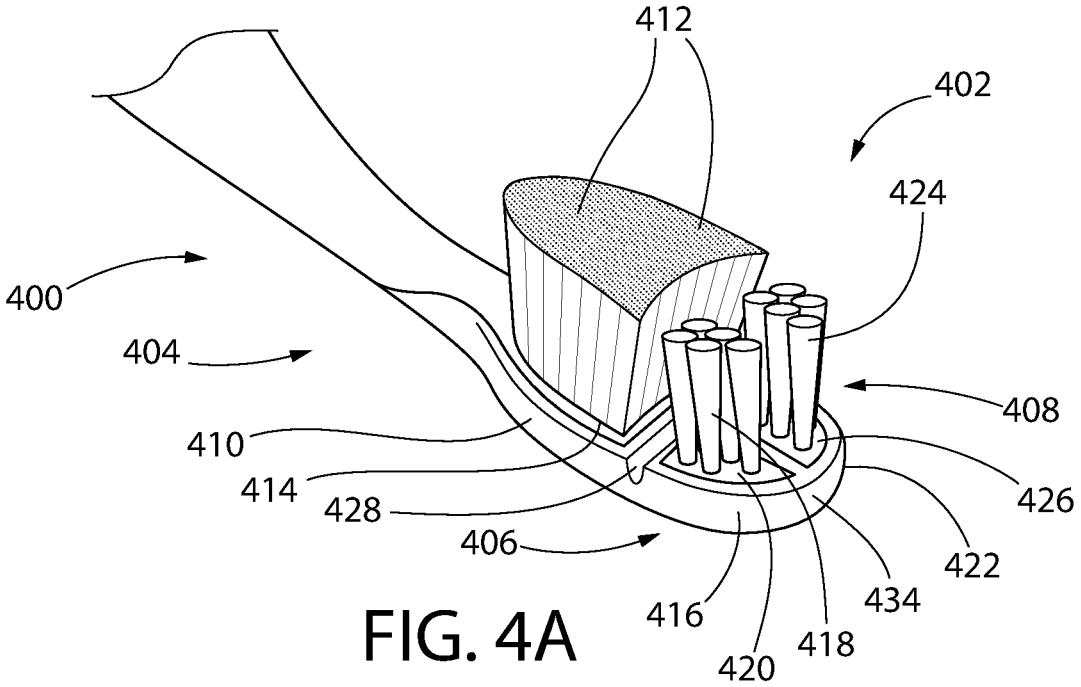
FIG. 4A is a perspective view of an oral care implement in a tooth brushing configuration, according to another example implementation of this disclosure.
Figure 4B:
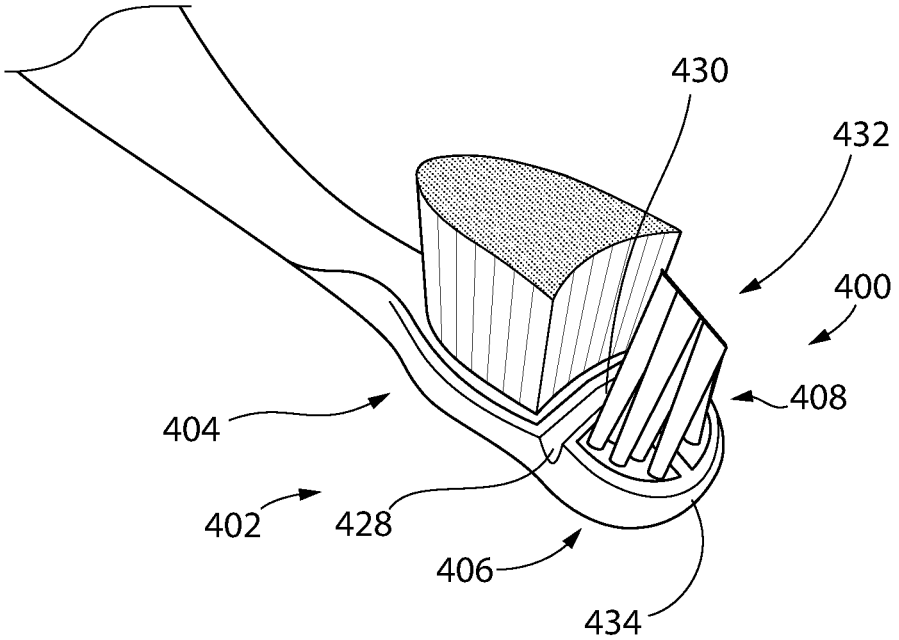
FIG. 4B is a perspective view of the oral care implement of FIG. 4A in an interdental cleaning configuration.
Figure 5B:
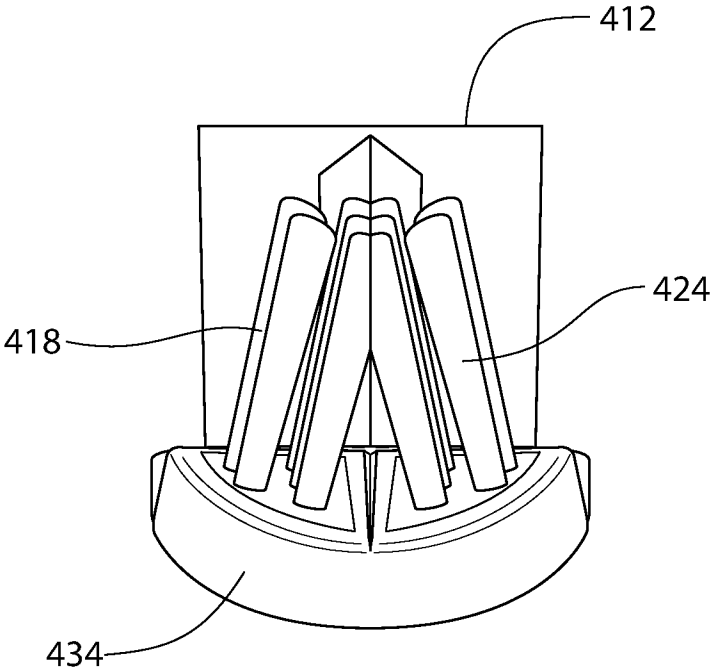
FIG. 5B is an elevation end view of the oral care implement of FIG. 4B, in the interdental cleaning configuration shown in FIG. 4B.
Figure 5A:
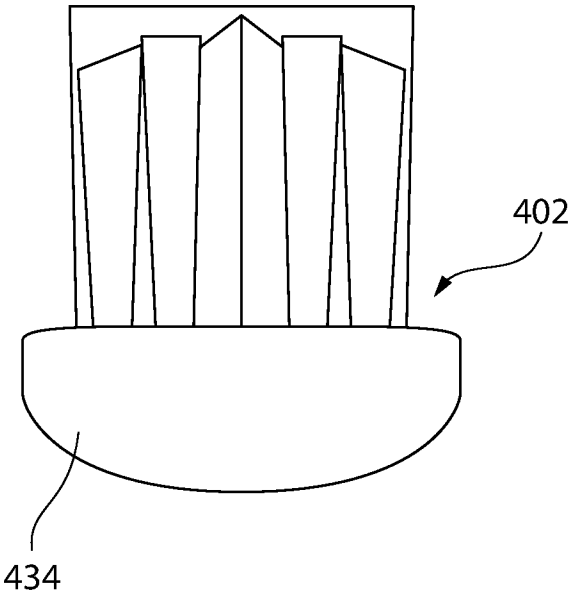
FIG. 5A is an elevation end view of the oral care implement of FIG. 4A, in the tooth brushing configuration shown in FIG. 4A.

The head 402 of the toothbrush 400 is configurable in both a tooth brushing position shown in FIGS. 4A and 5A and an interdental cleaning position illustrated in FIGS. 4B and 5B. In the interdental cleaning position, distal ends of the bristles 418, 424 of the movable cleaning elements 406, 408 pivot toward each other to form a bristle tip 432, similar to the toothbrush 100 described above. Unlike the toothbrush 100, however, when the toothbrush 400 is arranged in the interdental cleaning position, the bristles 418, 424 of the movable cleaning elements 406, 408 rotate away from the bristles 412 of the fixed cleaning element 404. Accordingly, the bristle tip 432 is directed away from the fixed cleaning element. This different arrangement may be more comfortable and/or effective for some users.

The toothbrush 400 is movable between the two positions by an actuating mechanism not shown in the Figures. The actuating mechanism may be substantially identical to the actuating mechanism shown in FIGS. 1A-3 or discussed above in connection with the toothbrush 100. When an actuating mechanism such as illustrated in FIGS. 2A, 2B, and 3 above is used, it should be apparent that actuation of the elongate arm along the arrow A of FIG. 4A will result in reconfiguration of the head 402 from the tooth brushing position to the interdental cleaning position, which is the opposite direction of travel required in the toothbrush 100. Other actuating mechanisms may also be used, as should be apparent to those having ordinary skill in the art with the benefit of this disclosure.

As illustrated in FIGS. 4A, 4B, and 5, the toothbrush 400 may also include a head cover 434 disposed over the first and second movable cleaning elements 406, 408. In the Figures, the hinges 428, 430 are living hinges formed as a part of the head cover 434 and the head cover 434 and the fixed cleaning element 404 are fixed to each other. Alternatively, the fixed bristle support 404, the first and second movable cleaning elements 406, 408, and/or the hinges 428, 430 may be formed as an integral or assembled piece, with the head cover 434 disposed over some of the features, e.g., to prevent debris, moisture and other contaminants from getting trapped between the components. The head cover 434 preferably is a flexible material that does not restrict the movement of the movable bristle supports 416, 422 as the head moves between the brushing configuration and the interdental cleaning configuration. The head cover 434 may be a rubber or highly flexible polymer, for example.

Other modifications to the embodiments discussed above also are contemplated. For example, although in the illustrated embodiments the surfaces of the fixed cleaning element and the movable cleaning elements are generally co-planar in the tooth brushing position, such is not required. In other embodiments one or more of the surfaces may be angled and/or offset relative to other of the surfaces in the brushing configuration.

Modifications also may be made to the actuation mechanisms described above. For example, the button or slider could be replaced with a threadably adjustable rod or other manual mechanism that would cause the elongate arm to move. In other implementations, the button or other manual interface may be disposed other than in the position shown.

For example, the button may be disposed on a back of the neck, at some other position along the handle or neck, or at the butt of the toothbrush. Alternatively, instead of a manual button or slider, an electro-mechanical actuator may be used to move the movable cleaning elements relative to the fixed element. A push-button could be used to control the actuator to move between the two positions, for example.

Although example embodiments have been described in language specific to the structural features and/or methodological acts, the claims are not necessarily limited to the specific features or acts described. Rather, the specific features and acts are disclosed as illustrative forms of implementing the example embodiments.

What is claimed is:

1. An oral care implement comprising:

a handle extending from a proximal end to a distal end;

a head disposed at the distal end of the handle, the head comprising:

a fixed bristle member comprising a first plurality of bristles on a fixed bristle support, a first movable bristle member comprising a second plurality of bristles on a first movable bristle support, and a second movable bristle member comprising a third plurality of bristles on a second movable bristle support; and an actuator configured to move the first movable bristle member and the second movable bristle member to selectively place the head in a brushing position in which the second plurality of bristles and the third plurality of bristles are disposed in a first orientation relative to the first plurality of bristles or in an interdental cleaning position in which the second plurality of bristles and the third plurality of bristles are angled relatively toward each other to form a bristle tip and the bristle tip is angled relative to the first plurality of bristles;

wherein the first movable bristle member rotates about a first axis of rotation and the second movable bristle member rotates about a second axis of rotation, the first and second axes of rotation being non-parallel.

2. The oral care implement of claim 1, wherein the actuator comprises an elongate member contacting the first movable bristle member and the second movable bristle member and movable relative to the fixed bristle member.

3. The oral care implement of claim 2, wherein the elongate member contacts the first movable bristle member and the second movable bristle member proximate a first end and is fixed at an opposite, second end, to an actuatable member.

4. The oral care implement of claim 3, wherein the actuatable member is configured for actuation by a user to move the actuator between the brushing position and the interdental cleaning position.

5. The oral care implement of claim 2, wherein the elongate member is fixed to at least one of the first movable bristle member or the second movable bristle member.

6. The oral care implement of claim 1, further comprising a first hinge connecting the first movable bristle member to the fixed bristle member and a second hinge connecting the second movable bristle member to the fixed bristle member.

7. The oral care implement of claim 6, wherein the first hinge and the second hinge are living hinges.

8. The oral care implement of claim 6, wherein the first hinge is configured to allow rotation of the first movable bristle member about the first axis of rotation, the second hinge is configured to allow rotation of the second movable bristle member about the second axis of rotation, and the first axis and the second axis are angled relative to each other and a longitudinal axis of the head.

9. The oral care implement of claim 1, wherein, in the interdental cleaning configuration, the bristle tip is angled relatively toward the first plurality of bristles.

10. The oral care implement of claim 1, wherein, in the interdental cleaning configuration, the bristle tip is angled relatively away from the first plurality of bristles.

11. An oral care implement comprising:

a handle;

a head disposed at a distal end of the handle, the head comprising:

a fixed cleaning member support, a first cleaning member disposed on the fixed cleaning member support, a first movable cleaning member support movable relative to the fixed cleaning member support, a second cleaning member disposed on the first moveable cleaning member support, a second movable cleaning member support moveable relative to the cleaning member support and the first movable cleaning member support, and a third cleaning member disposed on the second moveable cleaning member support; and an actuator disposed to pivot the first movable cleaning member support relative to the fixed cleaning member support about a first axis, to pivot the second movable cleaning member support relative to the fixed cleaning member support about a second axis, and the second movable cleaning member support relative to the fixed cleaning member support, and to actuate at least one of the first movable cleaning member and the second movable cleaning member support relative to each other;

a first hinge connecting the first movable cleaning element support to the fixed cleaning element support and a second hinge connecting the second movable cleaning element support to the fixed bristle support.

12. The oral care implement of claim 11, wherein the actuator comprises an elongate member disposed in the oral care implement.

13. The oral care implement of claim 12, wherein the elongate member extends from a proximal end disposed in the handle to a distal end contacting at least one of the first movable cleaning member support or the second movable cleaning member support.

14. The oral care implement of claim 11, wherein the first cleaning element comprises a first plurality of bristles, the second cleaning element comprises a second plurality of bristles, and the third cleaning element comprises a third plurality of bristles.

15. The oral care implement of claim 14, wherein the actuator is adjustable between a first position that configures the head in a first configuration and a second position that configures the head in a second configuration, wherein in the first configuration the second plurality of bristles and the third plurality of bristles are arranged in a first orientation and wherein in the second configuration the second plurality of bristles and the third plurality of bristles are angled relatively toward each other.

16. The oral care implement of claim 15, wherein in the second configuration distal ends of the bristles comprising the second plurality of bristles are angled toward distal ends of the bristles comprising the third plurality of bristles to form a bristle tip.

17. An oral care implement comprising:

a handle;

a head disposed at a distal end of the handle, the head comprising:

a fixed cleaning member support, a first cleaning member disposed on the fixed cleaning member support, a first movable cleaning member support movable relative to the fixed cleaning member support, a second cleaning member disposed on the first moveable cleaning member support, a second movable cleaning member support moveable relative to the cleaning member support and the first movable cleaning member support, and a third cleaning member disposed on the second moveable cleaning member support; and an actuator disposed to pivot the first movable cleaning member support relative to the fixed cleaning member support about a first axis, to pivot the second movable cleaning member support relative to the fixed cleaning member support about a second axis, and the second movable cleaning member support relative to the fixed cleaning member support, and to actuate at least one of the first movable cleaning member and the second movable cleaning member support relative to each other;

wherein the actuator comprises an elongate member disposed in the oral care implement;

wherein the elongate member includes at the distal end a first member contacting the first movable cleaning member support and a second member contacting the second movable cleaning member support.

18. The oral care implement of claim 17, wherein the first member is fixed relative to the second member.

19. A toothbrush comprising:

a handle extending from a proximal end to a distal end; and a head disposed at the distal end of the handle, the head comprising:

a fixed bristle member comprising a first plurality of bristles on a fixed bristle support, a first movable bristle member comprising a second plurality of bristles on a first movable bristle support, a first hinge connecting the first movable bristle member to the fixed bristle member, wherein the first movable bristle member pivots relative to the fixed bristle support, via the first hinge, about a first axis, a second movable bristle member comprising a third plurality of bristles on a second movable bristle support, and a second hinge connecting the second movable bristle member to the fixed bristle member, wherein the second movable bristle member pivots relative to the fixed bristle support, via the second hinge, about a second axis angled relative to the first axis;

wherein when the first and second movable bristle members are pivoted into an interdental cleaning position, at least one bristle of the first plurality of bristles of the fixed bristle support, at least one bristle of the second plurality of bristles of the first movable bristle member, and at least one bristle of the third plurality of bristles of the second movable bristle member intersect at a point.

20. The toothbrush of claim 19 further comprising an actuator, wherein the actuator is disposed to pivot the first movable cleaning member about the first axis and the second movable cleaning member about the second axis.

* * * * *